US008278541B2

(12) United States Patent
Dorfman et al.

(10) Patent No.: US 8,278,541 B2
(45) Date of Patent: Oct. 2, 2012

(54) DRUM PEDAL WITH OPTICAL SENSOR

(75) Inventors: Michael Dorfman, Prairie View, IL (US); Thomas Baker, West Lafayette, IN (US); Alexander Moon, West Lafayette, IN (US); George Szwaya, East Troy, WI (US)

(73) Assignee: Trick Percussion Products, Inc., Arlington Heights, IL (US)

( * ) Notice: Subject to any disclaimer, the term of this patent is extended or adjusted under 35 U.S.C. 154(b) by 59 days.

(21) Appl. No.: 13/005,389

(22) Filed: Jan. 12, 2011

(65) Prior Publication Data

US 2012/0174734 A1 Jul. 12, 2012

(51) Int. Cl.
*G10D 13/02* (2006.01)

(52) U.S. Cl. ..... 84/422.1

(58) Field of Classification Search ..... 84/422.1
See application file for complete search history.

(56) References Cited

U.S. PATENT DOCUMENTS 4,819,536 A * 4/1989 Lombardi ..... 84/746
6,201,173 B1 * 3/2001 Black ..... 84/422.1
7,435,888 B2 * 10/2008 Steele ..... 84/422.1

* cited by examiner

*Primary Examiner* — Jianchun Qin
(74) *Attorney, Agent, or Firm* — Beem Patent Law Firm

(57) ABSTRACT

A drum pedal sensing system may include a base, a foot board, a pedestal, a beater, beater stem, and beater holder operatively connected to the foot board, a sensor holder, and a sensor fixedly coupled to the sensor holder. The beater holder may include a sensing surface that may rotate as the foot board is depressed and that may remain a substantially constant distance from the sensor as the sensing surface rotates. Additionally, the system may include a microprocessor operatively coupled to the sensor that receives signals from the sensor corresponding to motion of the sensing surface. Based on sensed changes such as changes in position, velocity, or acceleration, the microprocessor may determine whether the beater has contacted a drum face and, if so, may send an output signal to a stomp box, drum brain or similar element, with the amplitude of this output signal proportional to strength of the hit.

20 Claims, 6 Drawing Sheets

DRUM PEDAL WITH OPTICAL SENSOR

BACKGROUND

1. Field of the Invention

This invention relates to musical instruments, more specifically, the invention is directed to a drum pedal having a sensor for detecting movement of the pedal to create an output signal for use with digital and/or analog devices.

2. Background of the Invention

Drummers typically use a pedal to strike a bass drum or the like. A bass drum pedal is operated by depressing a foot board and causing a beater to hit the surface of a drum. When the foot board is depressed, a drive assembly causes the beater to strike the drum. When the foot board is released, the beater returns to a ready position, ready for the next beat.

It may be desirable to record or sample beater strikes in order to convert these strikes to output a signal to a drum brain and eventually to an amplifier, a MIDI system, headphones, etc. Traditionally, this has been achieved by attaching a piezoelectric transducer or pickup to the drum face. With this system, drum hits in quick succession may not be detected properly by the system because dampening of the drum head may occur so slowly that the amplitude of vibration may not change substantially from one hit to the next. Because a piezo sensor outputs a voltage proportional to the amplitude of the vibration of the drum head, and because the amplitude of vibration of the head may not change significantly from one hit to the next, including the time between hits, the drum brain may be unable to distinguish the hits. Conversely, powerful hits may result in the pedal striking the face more than once, e.g., on a rebound. In this case, a strong hit may be interpreted incorrectly as multiple hits.

One attempt to improve upon this system involves adding a second, smaller beater to the drum pedal. This second beater may be aligned with the transducer so that it strikes the transducer directly. In addition to the rebounding problem discussed above, this modification requires careful alignment of the drum pedal to ensure that the transducer is hit, making modification to the system difficult or impossible, especially during use.

What is needed is a drum pedal and/or pedal system that overcomes the drawbacks described above.

SUMMARY OF THE INVENTION

In one aspect, a drum pedal may include a base, a foot board, a pedestal with an axis extending upwardly from the base, a drive system operatively connected to the foot board, and a sensor, such as an optical laser, fixedly coupled to the pedal for directly or indirectly sensing motion of the drive system. The drive system may include a beater operatively coupled to a beater holder. The beater holder may include a sensing surface that rotates and remains a substantially constant distance away from the sensor as the beater rotates, and the sensor may sense motion of the sensing surface, specifically velocity or changes in velocity.

The pedal may include a sensor mount fixedly coupled to the pedestal. The sensor mount may include a cavity configured to receive the sensor. In addition, the sensor outputs signals corresponding to drum strikes based on changes in acceleration.

In another aspect, a drum pedal sensing system may include a sensor, the sensor configured to detect direct or indirect motion of a drum beater, and a logic processor, which may include a microprocessor and/or other digital or analog components, operatively coupled to the sensor and configured to receive signals from the sensor. The sensor may detect changes in position along a sensing surface from a first request to a second request, which may be spaced apart by a predetermined amount of time. The microprocessor or other logic may determine a net change in position between the two requests, and given the time span between requests, may interpret that change in position as a velocity value. Additionally, acceleration values may be derived from these position and/or velocity calculations, which may be used to modify or adjust other calculations. Moreover, the logic processor may evaluate the signals to determine when the drum beater reaches a strike position, i.e., when it strikes a drum, practice pad or other surface, or when it reaches a position correlating to a drum strike.

The system also may include a digital-to-analog converter and an input-output connector, such as a 5-pin DIN connector, operatively coupled to the logic processor. In addition, the system may include a power supply, a stomp box, and a drum brain operatively coupled to the sensor and the logic processor via the input-output connector. The logic processor may output a signal each time it determines that the drum beater strikes the drum, and the output signal may be a square wave having an amplitude proportional to a strength of the strike.

In yet another aspect, a drum pedal sensing system may include a base, a foot board, a pedestal with an axis extending upwardly from the base, a beater, beater stem, and beater holder operatively connected to the foot board, a sensor holder, and a sensor fixedly coupled to the sensor holder. The beater holder may include a sensing surface that may rotate as the foot board is depressed and that may remain a substantially constant distance from the sensor as the sensing surface rotates. The system also may include a drive shaft extending from the pedestal, where the beater holder and sensor holder are coupled around the drive shaft.

Additionally, the drum pedal sensing system may include a microprocessor operatively coupled to the sensor. The sensor may send signals to the microprocessor corresponding to motion of the sensing surface, and the microprocessor may evaluate the signals to determine whether the beater has contacted a drum face. The microprocessor may be operatively coupled to a digital-to-analog converter, and the microprocessor or converter may output a signal when the microprocessor determines that the beater has contacted the drum face. The amplitude of this output signal may be proportional to strength of the hit, i.e., of the contact of the beater with the drum face. Moreover, the sensor holder may include a cavity configured to house the sensor and the microprocessor and an opening for making a connection with an input/output connector.

These and other features and advantages are evident from the following description of the present invention, with reference to the accompanying drawings.

DETAILED DESCRIPTION OF THE INVENTION

Figure 1:
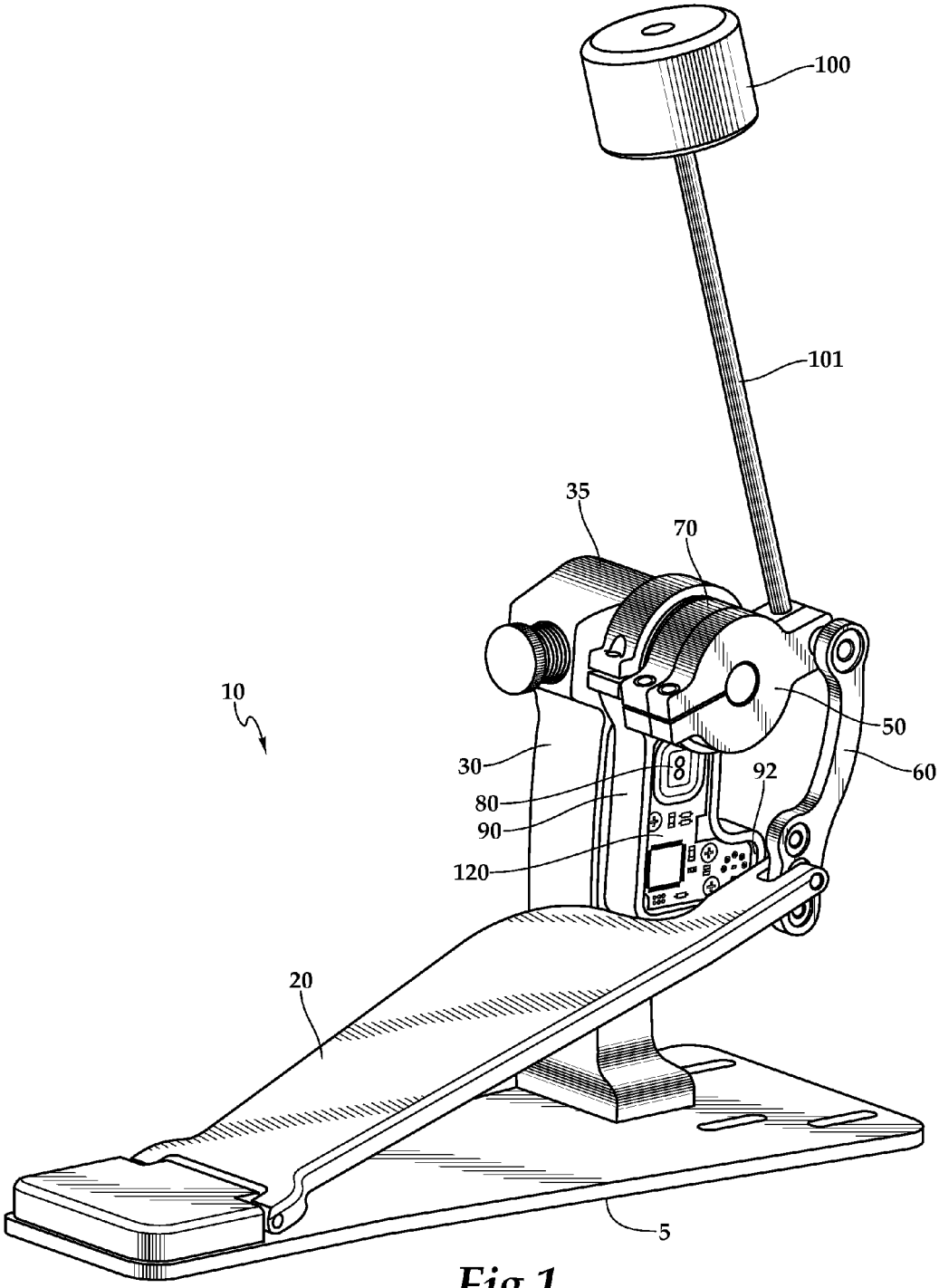
FIG. 1 is a perspective view of one embodiment of a drum pedal with a mounted sensor for detecting direct or indirect motion of the drum beater.

As shown generally in FIGS. 1-4, drum pedal 10 may include base 5, foot board 20, and beater 100 actuated by depression of foot board 20. Pedal 10 also may include one or more pedestals 30 or posts extending generally upward from base 5 and a drive assembly 300 supported by pedestal 30, which may include drive shaft 40, rotatably adjustable drive ring 50 having arm 56, and rotatably adjustable beater ring 70. Base 5 may take on various configurations. For example, as seen in FIG. 1, base 5 may be a substantially planar surface having a length and width generally similar to length and width of foot board 20. In another example, base 5 may be substantially smaller, e.g., a narrow rod extending underneath foot board 20; other types of bases also are possible.

Link 60 may connect foot board 20 with arm 56. Foot board 20 may have two ends, heel end 21 and toe end 22. Heel end 21 may pivotally attach to base 5 by heel pin 25. Foot board 20 may reside at an incline in relation to base 5 with heel end 21 in contact with base 5 and toe end 22 suspended some distance above base 5. Foot board 20 may move from a raised position to a depressed position. The raised position also may be called a ready position and the depressed position may be called a strike position.

The details of drive assembly 300 may vary from drum pedal to drum pedal. For example, several examples of drum pedal drive systems may be seen in the commonly assigned U.S. Pat. No. 7,456,351 to Dorfman, et al., issued Nov. 25, 2008, the details of which are incorporated herein by reference. Other examples of drum pedal drive assemblies may be seen in, inter alia, U.S. Pat. Nos. 7,855,331 to Chen, 7,579,540 to Takegawa, and 6,953,884 to Dennis, et al. Despite the various types of drive assemblies disclosed in each of these references, common details among these and other pedals, including the present pedal, are that the beater 100 may have stem 101 coupled to a holder 70 (such as the beater ring in FIG. 1) and that, when foot board 20 is depressed, holder 70, stem 101, and beater 100 rotate and are actuated to a forward position so as to strike the drum head.

Pedestal 30 may extend upwardly from base 5 and support drive assembly 300. In one embodiment, pedestal 30 may have a support ring 35 near the top of pedestal 30. Pedestal 30 may be mounted on, and affixed to, base 5 or may be formed integrally with base 5. Pedestal 30 and support ring 35 may be of unitary construction of aluminum casting and may be firmly affixed to base 5 by fasteners coming up from base 5 and extending into the base of pedestal 30. Unitary aluminum construction may prevent support ring 35 from twisting in relation to pedestal 30 and disorienting drive shaft 40. Drive shaft 40 should be oriented generally parallel to the axis of the arc traveled by beater 100, particularly as the axis about which beater 100 rotates may be collinear with axis of drive shaft 40. Drive shaft 40 may be journaled at one or more points along its axis or at both ends. As shown in FIG. 1, in one embodiment, drive shaft 40 may be journaled within housing or support ring 35. Drive shaft 40 extends generally horizontally through center of support ring 35.

The force exerted by foot board 20 on beater 100 may be adjustable through use of an adjustable drive ring such as rotatably adjustable drive ring 50 and link 60, which may include a plurality of alternative positions 62 to which foot board 20 may be connected, as seen in FIG. 1, and/or a plurality of alternative positions (not shown) to which drive ring 50 may be connected.

Figure 2:
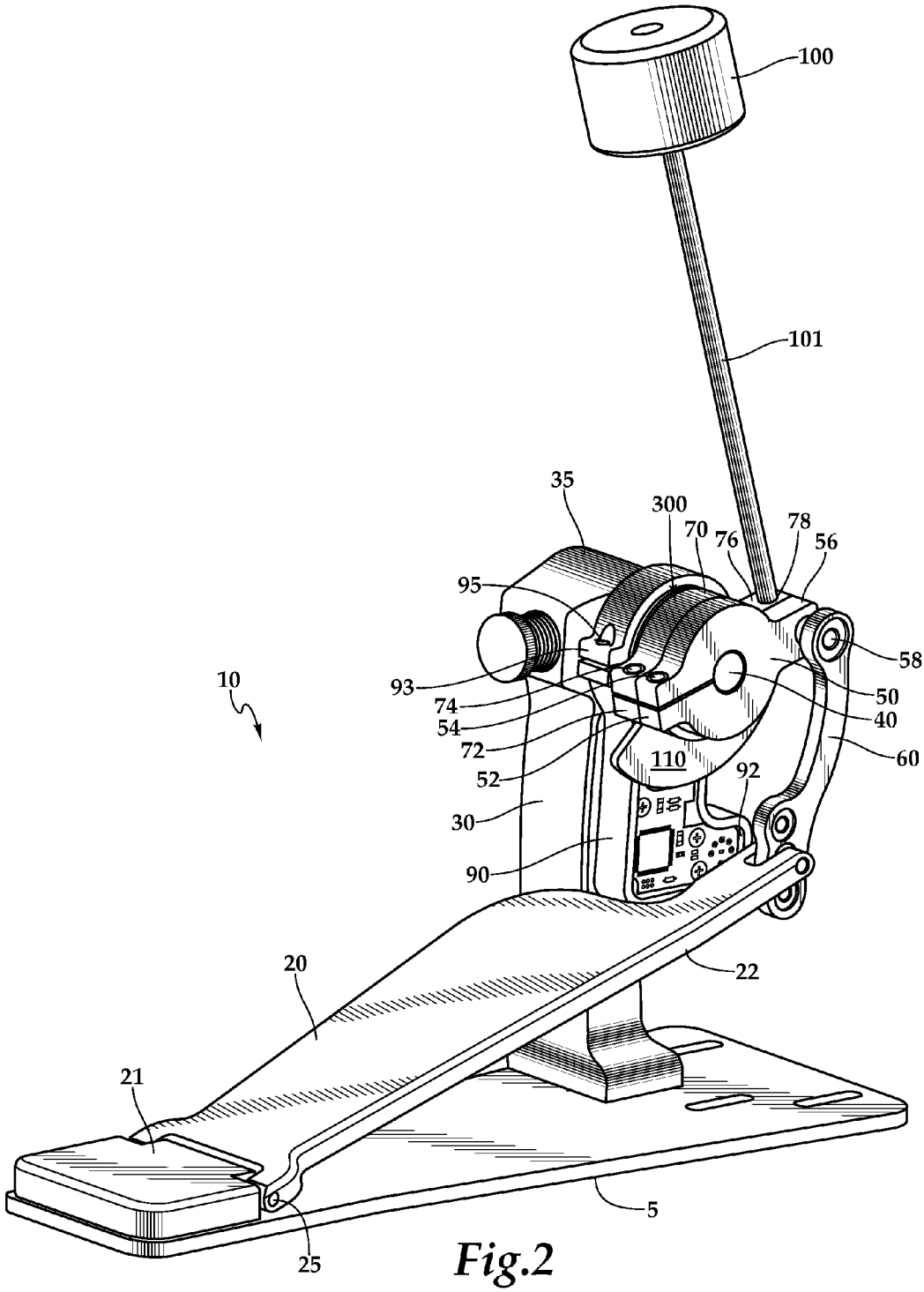
FIG. 2 is a perspective view of the drum pedal of FIG. 1 with an additional extension having a sensing surface extending downward from the beater holder.
Figure 3:
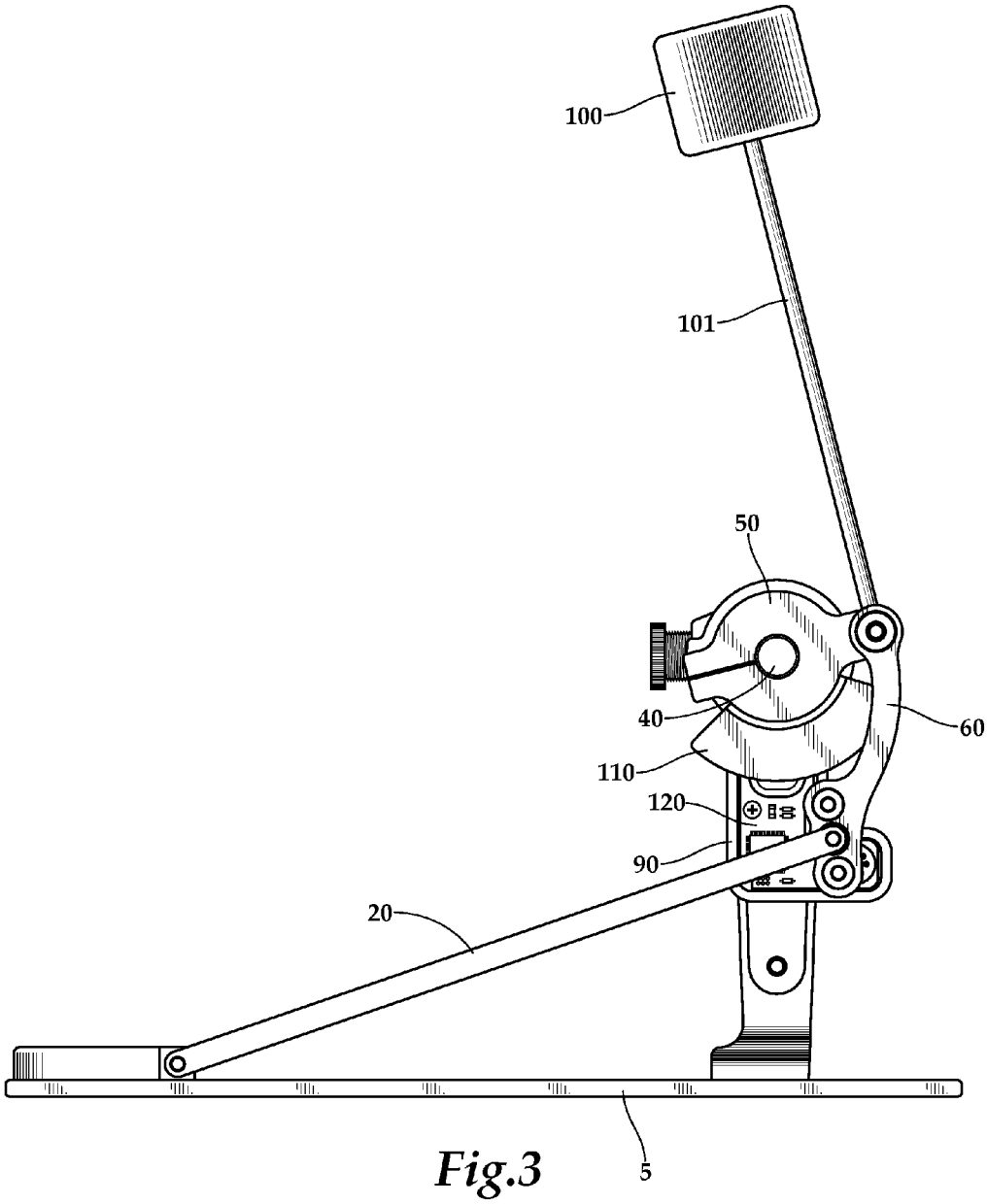
FIG. 3 is a side view of the drum pedal of FIG. 2
Figure 4:
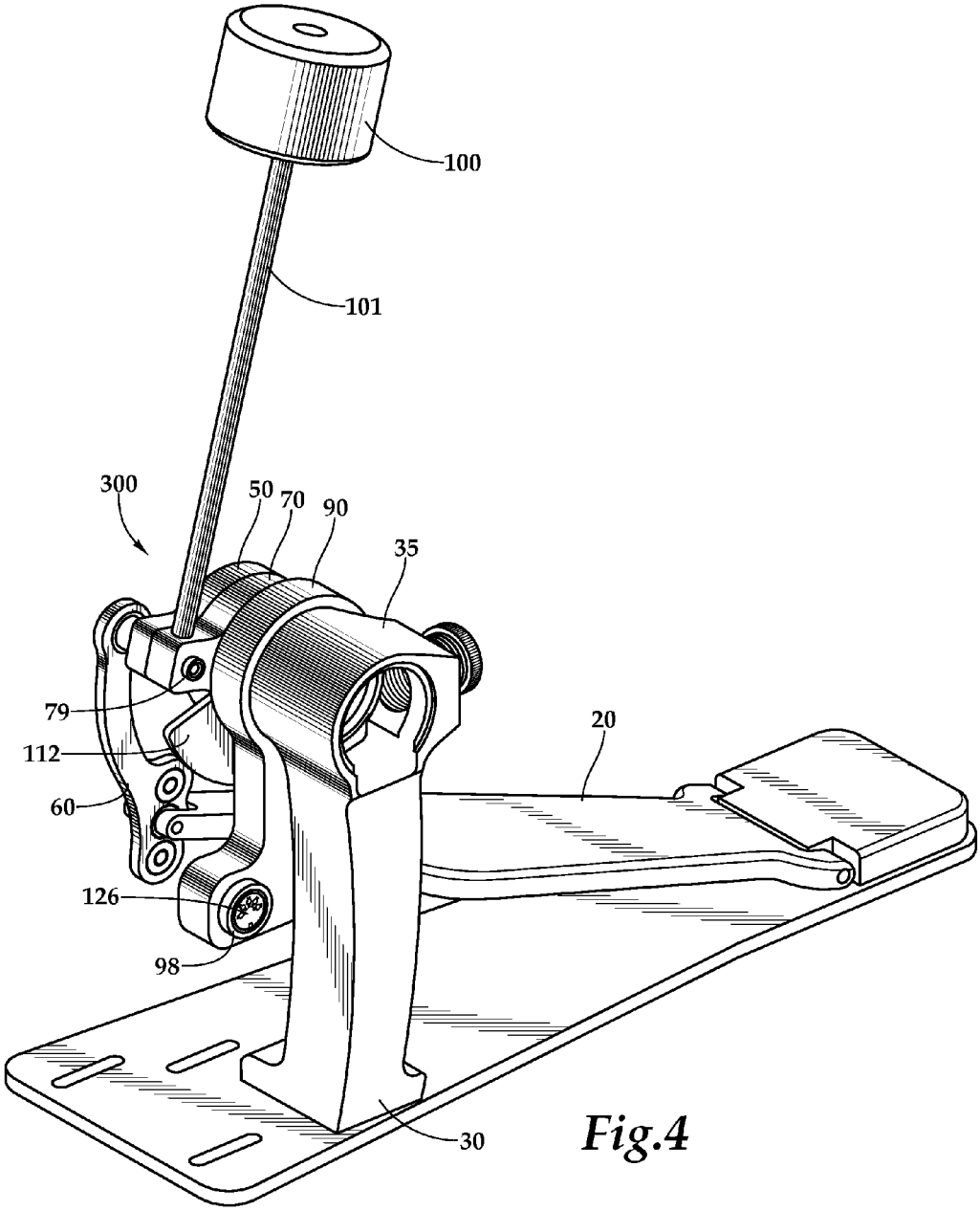
FIG. 4 is a reverse perspective view of the drum pedal of FIG. 2.

As shown in FIGS. 1 and 2, drive ring 50 may be one ring clamped onto drive shaft 40. Drive ring 50 may be adjustable in orientation about drive shaft 40. Drive ring 50 may have drive clamp protrusion 52 that may be slit from the end of drive clamp protrusion 52 to drive shaft 40 resulting in two drive protrusion ends that may be uncoupled from drive shaft 40. Drive ring screw 54 holds together both drive clamp protrusion ends to keep drive ring 50 tightly affixed to drive shaft 40. Drive ring 50 also may have arm 56 on the opposite end of drive ring 50 from drive clamp protrusion 52. Arm 56 may have link pin 58 that pivotally attaches to drive portion of link 60. Link pin 58 may be spaced a predetermined distance from drive shaft 40 by arm 56. Arm 56 may provide leverage for force exerted on drive ring 50 by link 60.

In this embodiment, drive ring 50 may be adjusted to different orientations around drive shaft 40, providing drummers with a range of speed and a range of acceleration with which beater 100 moves toward a drum in order to best control the rhythm of the beat. A crank angle may be formed at drive rod hinge or link pin measuring the angle between link 60 and the line formed from drive shaft 40 to link pin 58, and the crank angle affects the speed with which the head of beater 100 may be accelerated toward the surface of the drum. When the crank angle is acute in the ready position, the depression of foot board 20 may cause beater 100 to accelerate in velocity until crank angle 170 reaches 90 degrees, and then decelerate in velocity after crank angle exceeds 90 degrees. When drive ring 50 is adjusted so that the crank angle is 90 degrees or more at the ready position, beater 100 may decelerate towards drum surface upon depression of foot board 20. Since different drummers have different senses of timing, a range of accelerations and decelerations of the beater may be an important variable to have available.

In addition to adjustable drive ring 50, drum pedal 10 also may have adjustable beater ring 70. Adjustable beater ring 70 may allow a drummer to set the predetermined arc distance beater 100 travels to strike a drum. Beater ring 70 may be situated between drive ring 50 and support ring 35. Beater ring 70 may have beater clamp protrusion 72 that may be slit from the end of beater clamp protrusion 72 to drive shaft 40 resulting in two beater protrusion ends. Beater ring screw 74 screws together both beater protrusion ends to keep beater ring 70 tightly affixed to drive shaft 40. Beater ring 70 also may have holder protrusion or arm 76 on opposite end of beater ring 70 from beater clamp protrusion 72 and holder protrusion 76 may have beater stem hole 78 extending through holder protrusion 76 for holding stem 101 of drum beater 100.

Beater stem screw 79 may fit into the side of holder protrusion 76 to hold stem 101. Beater stem screw 79 may be loosened to adjust the length of stem 101 held between holder protrusion 76 and beater 100. Beater stem screw 79 may be tightened to keep stem 101 from moving within beater stem hole 78. Beater 100 may be actuated by drive shaft 40 in connection with foot board 20 from a rearward or rear position to a strike position.

Beater ring 70 may be adjustable to control the arc distance beater 100 travels to strike the surface of a drum. Beater 100 may be set so stem 101 is oriented close to perpendicular and beater 100 travels a short arc distance before striking the surface of the drum. Foot board 20 may not need to be depressed very far to actuate beater 100 to strike the surface of the drum when stem 101 is oriented close to perpendicular. Beater 100 may be set so that stem 101 is oriented closer to horizontal at the ready position. In this orientation, beater 100 may have to travel a longer arc distance to strike the surface of the drum. Foot board 20 may have to be depressed a greater distance downwardly to actuate beater 100 to travel the longer arc distance to the surface of the drum from the ready position. The distance of the beater arc may also affect the speed at which beater 100 strikes the surface of the drum. A longer arc distance allows beater 100 more time to accelerate towards the drum. An adjustable beater ring 70 allows drummers more options in fine tuning the operation of their instruments.

Beater ring screw 74 may be loosened so that beater clamp protrusion 72 may have two uncoupled ends. Loosening beater ring screw 74 allows beater ring 70 to unclamp from drive shaft 40. The orientation of beater ring 70 may be changed so that beater clamp protrusion 72 points more downwardly. This causes beater stem hole 78 to orient close to horizontal and causes beater 100 to travel a longer arc distance to strike the drum. Tightening beater ring screw 74 may tightly couple the two ends of beater clamp protrusion 72, thus clamping beater ring 70 tightly to drive shaft 40 in the new orientation. The angles of adjustment of beater ring 70 may preferably be between about 100 degrees from horizontal and about the angle of the surface of the drum, more preferably between about 80 degrees from horizontal and about the angle of the surface of the drum, and most preferably between about 60 degrees and about the angle of the surface of the drum.

Foot board 20 actuates beater 100 through drive assembly 300. In FIGS. 1-2, drive assembly 300 may have drive shaft 40 with a generally horizontal axis journaled within drive assembly 300. In one embodiment, drive shaft 40 may be positioned generally horizontally by support ring 35.

Turning to FIG. 1, pedal 10 may include a sensor 80, which may include a laser, infrared transmitter, a light emitting diode (LED), etc., and a charge-coupled device (CCD) image sensor, a complimentary metal-oxide semiconductor (CMOS) sensor, or another image sensor. Sensor 80 may be mounted anywhere that has a view of beater ring 70, beater 100, and/or beater stem 101. Preferably, sensor 80 may be fixedly mounted on, or coupled to, pedal 10 to observe movement of beater 100, either directly or indirectly. For example, sensor 80 may be mounted so as to observe movement of beater ring 70. In this regard, fixedly mounted means that sensor 80 preferably does not move as foot board 20 is depressed, although sensor 80 may be separable or removable from pedal 10 if so desired.

Pedal 10 may include a sensor mount 90, and beater ring 70 may include an extension 110 extending downward from beater ring 70 and having a sensing surface 112. Extension 110 may be part of beater ring or may be couplable to beater ring. Sensing surface 112 may be generally perpendicular to sensor 80 and may remain a substantially constant distance away from sensor 80 as beater ring 70 and beater 100 rotate. Sensing surface 112 may include visual cues, a code strip, or other indicators such that sensor and sensing surface may form an optical encoder. In still another embodiment, pedal 20 may include a light transmitter, movement of beater 100 may result in breaks in the transmitted light beam(s), and sensor 80 may detect movement by detecting these breaks. Preferably, however, sensing surface is a generally solid, opaque surface such as unfinished or painted anodized aluminum, aluminum covered in electrical or other tape, or some other opaque surface, and sensor 80 is configured to optically track motion of the sensing surface 112.

Sensing surface 112 may have an angular or circumferential extent large enough to remain within field of vision of sensor 80 the entire time foot board 20 and beater ring 70 move from a ready position to a strike position. Preferably, sensing surface 112 further may have an angular or circumferential extent large enough to remain in field of vision of sensor regardless of the degree to which beater ring 70 is adjusted, prior to depressing foot board 20. For example, sensing surface 112 may have an angular or circumferential extent between about 45 degrees and about 360 degrees, preferably between about 60 degrees and about 180 degrees, still more preferably between about 90 degrees and about 180 degrees, and in one embodiment, about 120 degrees.

Figure 5:
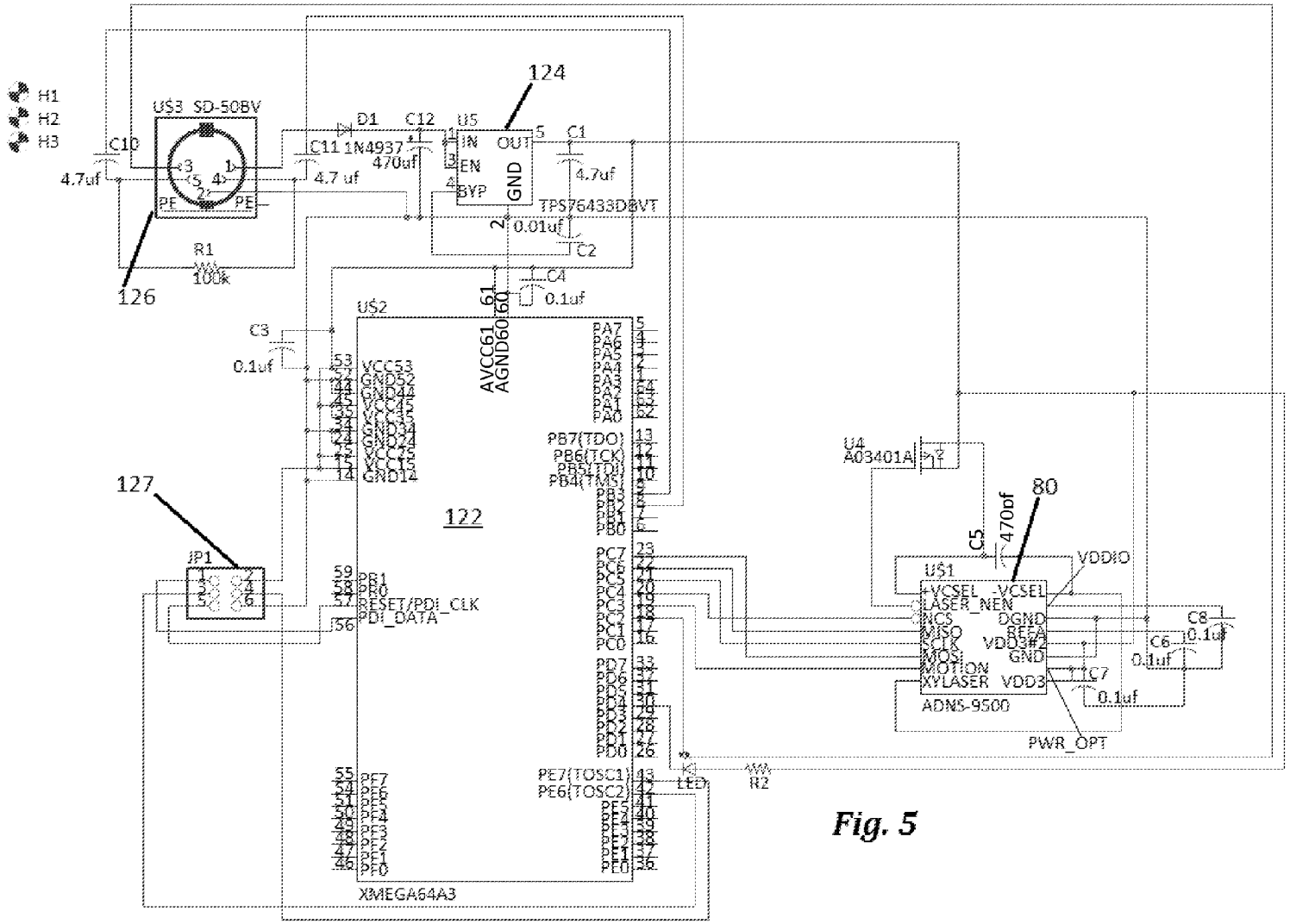
FIG. 5 is an exemplary circuit diagram of components that may be disposed within a sensor holder for use with the drum pedal of FIGS. 1-4.
Figure 6:
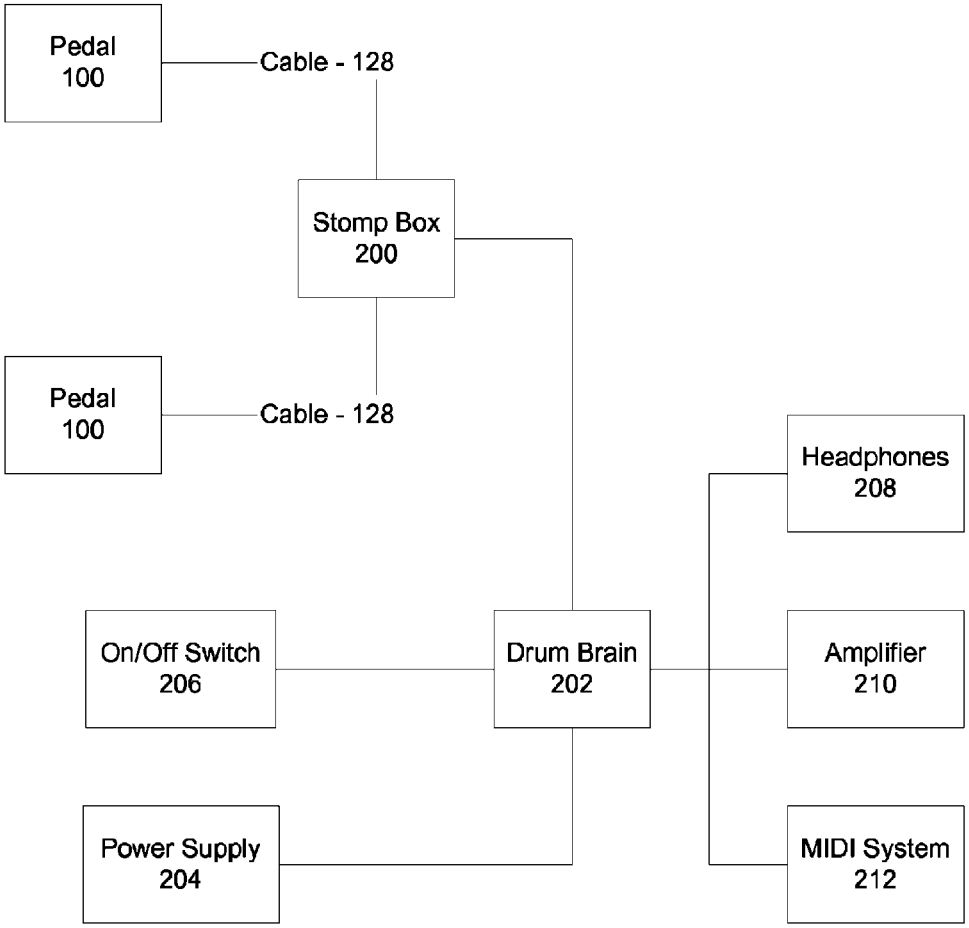
FIG. 6 is a diagram showing a drum pedal connected to various other components.

Sensor mount 90 may include a cavity 92 configured to receive sensor 80 and other components. For example, sensor 80 may be operatively coupled to a circuit board 120, to which a microcontroller 122, voltage regulator 124, input/output connector 126, programming interface connector 127, and one or more capacitors, resistors, and/or diodes also may be operatively coupled. One example of a circuit diagram for the components of circuit board 120 may be seen in FIG. 5.

In this example, microcontroller 122 may be an Xmega64A3-AU made by Atmel Corporation, although other microcontrollers may be used. Microcontroller 122 may be responsible for all central processing of input signals from sensor 80, calculating whether a drum hit was detected and, if so, outputting a simulated piezo voltage. The output voltage may be substantially proportional to the strength of the impact of beater 100.

Voltage regulator 124 may adjust input voltages, e.g., lowering input voltage to about 3.3V. Voltage regulator 124 also may be useful in filtering out power noise.

Input/output connector 126 may be a standard 5-pin DIN cable connector such as those used to make MIDI connections, although other connectors may be used. In the 5-pin DIN connection, individual pins may carry: power, ground, a doubler input, an output+, and an output−. The cable 128 may be a standard quarter-inch cable and may extend from connector 126 to a stomp box 200, which may include a matching DIN connector. The stomp box may include an output connection, e.g., a mono ¼" audio jack for output to a drum brain 202. As discussed below, the system may be used with a double drum pedal configuration. In a multi-pedal embodiment, the stomp box may include a plurality of DIN connectors, one for each pedal, and the drum brain may include a similar plurality of inputs such as ¼" audio jacks. The drum brain also may include connections for a power-in jack 204, a foot-activated on/off switch 206 for the doubler input, and an LED or other indicator to make the user aware of the doubler input state. From there, the drum brain may connect to headphones 208, an amplifier 210, a MIDI system 212, or a combination of the three, as desired.

Sensor mount 90 also may include a plurality of openings 95 for receiving fasteners for securing a cover 96 to mount 90. Cover 96 may cover cavity 92 substantially completely, while leaving an opening through which sensor 80 may send and receive signals. Sensor mount 90 also may include an opening 98 through which input/output connector 126 may extend or through which a connection to input/output connector 126 may be made. As seen in FIG. 1-4, sensor mount 90 may be generally L-shaped, with the majority of mount 90 generally aligned with pedestal 30 and a toe portion extending to the side of pedestal. Opening 98 may be disposed on this toe portion, on the side of sensor mount 90 opposite from the opening to cavity 92 so that, when a cable 128 is connected to input/output connector 126, cable 128 may extend away from foot board 20 so as to not interfere with operation of pedal 10.

Like drive ring 50 and beater ring 70, sensor mount 90 may include a protrusion 93 separable into a plurality of arms through which a fastener 95 may be driven. Loosening fastener 95 may separate arms and allow for rotational adjustment of sensor mount 90, while tightening fastener 95 may secure sensor mount 90 in a substantially fixed configuration with respect to pedestal 30 and/or drive shaft 40. Although sensor mount 90 may be mounted around drive shaft 40, sensor mount 90 may be configured to not rotate as drive shaft 40 rotates when foot board 20 is depressed.

Spacing between sensor 80 and sensing surface 112 may remain substantially constant and may be determined based on the specifications of the sensor. For example, sensor 80 may be similar to a high performance laser computer mouse sensor. Typical specifications for this sensor may require placing the lens of the sensor about 2.2 mm from the sensing surface +/−about 0.22 mm. Additionally, sensor 80 preferably is selected so that it can track the rapid movement of beater ring 70 that occurs when pedal is depressed. For example, sensor may sample movement about once per millisecond (1000 Hz), although sample speeds up to and including about 10 kHz also may be possible. Sampling speed also may be dynamically variable based on how much movement the sensor sees. In addition, the sensor may be able to detect motion at about 150 inches/second and accelerations up to and including about 30 Gs. Moreover, sensor 80 may have a frame rate up to and including about 11,750 Hz, with a resolution of about 5,000 counts/inch.

Sensor 80 may be used to determine velocity or acceleration of beater 100, specifically of beater ring 70, as opposed to location or position, although as discussed above, sensor may be configured to analyze positions to determine movement of beater 100. In that embodiment, pedal 20 preferably includes a base or home configuration that may be used to calibrate sensor 80, e.g., the beater may be placed against the drum head with this configuration being considered the base position. This configuration also may be helpful to recalibrate sensor in the case of drift over time. Alternatively, without a home configuration, position tracking may be used by effectively guessing at a zero point for the beater. The sensed movement may be used to derive the beater position based on deviations from that zero point.

As pedal 20 is depressed, beater ring 70, beater 100, and beater stem 101 accelerate towards drum head. Beater 100 then decelerates at the point of impact and continues as it pushes the drum head inward. Eventually, beater 100 stops and changes direction to move in the opposite (negative) direction. Sensor 80 may recognize these changes in movement or velocity, transmitting signals to microprocessor 122.

Based on the sensed velocities and/or accelerations, microprocessor 122 may use an algorithm or heuristic to determine when and how hard beater 100 hit the drum. For example, one part of the heuristic may involve having a baseline velocity (or negative velocity) that may correlate to what would be expected as beater flops back without hitting the drum face. Deviations above this baseline may be interpreted as a hit, and the degree of deviation may correlate to the strength of the hit. Similarly, deviations below this hit may be interpreted as pedal depressions that failed to reach drum face and may be interpreted as no hit.

Additionally, the heuristic may be modified to recognize and interpret accelerations corresponding to multiple hits in quick succession, multiple inadvertent drum face hits that result from hitting the pedal hard, changes in acceleration that correspond to the pedal being depressed but the beater not contacting the drum face, and slight accelerations corresponding to light hits.

Once sensor 80 detects beater motion and transmits signals to microcontroller 122, and after those signals are processed, output signals may be transmitted through cable 128 connected to input/output connector 126 to a stomp box and then to a drum brain or other device.

Output signals may be created that are usable with already-existing drum brain technology. For example, drum brains may be configured to receive analog piezoelectric transducer signals. To simulate these signals, the digital signals may pass through a D/A converter so that the output signals may take the form of a square wave. This converted signal may resemble the analog signal produced by a piezoelectric transducer, but it may be substantially "cleaner" than that analog signal, reducing or eliminating background noise.

Each drum hit may result in the creation of a wave, where the wave amplitude may be proportional to the strength of the hit. In one embodiment, the wave may be a square wave comprising solely positive peaks for each drum hit. Preferably, however, the wave that is created may be a double-ended or plus-minus square wave. This double-ended square wave may be useful for drum brains that analyze polarity or that are configured to receive signals from piezoelectric transducers. In addition, when the wave is created and transmitted, it may be decoupled from the circuit to eliminate any voltage differences that may exist between sensor 80 and the drum brain. Decoupling may be accomplished using a capacitor or, in the event a double-ended wave is generated, using a pair of capacitors.

In another embodiment, output signals may be sent to MIDI devices, which may eliminate the need for a D/A converter or for the signal to pass through a D/A converter.

As stated above, the amplitude of each wave may be proportional to the strength of the corresponding hit. Conversely, for each hit, the generated wave period may be substantially similar to the period of other hits. In one embodiment, the period (or half-period in the case of double-ended waves) may be about 1 millisecond (or 1 millisecond high followed by 1 millisecond low for double-ended waves). Although this period may be variable or modifiable, modifications should be made with the drum brain in mind, because some drum brains occasionally may miss hits if the period is too short. Conversely, if the period is too long, the drum brain may interpret the hit as stronger than it actually was. In another embodiment, the wave that is output may have a generally constant amplitude for each hit with a variable period, with the length of the period correlating to the strength of the hit. In still another embodiment, a combination of a variable amplitude and a variable period may be used.

As described above, sensor 80 may be fixed to pedal 10 to detect sensing surface 112 that moves as pedal 10 is depressed. In an alternative embodiment, sensing surface 112 may remain generally stationary, while sensor 80 may move as pedal 10 is depressed. For example, sensor 80 may be coupled to beater ring 70, and sensing surface 112 may be formed on or coupled to pedestal 30. In this embodiment, sensor 80 may be operatively coupled to circuit board 120, which may be operatively coupled to input/output connector 126 and cable 128. As such, cable 128 also may move each time pedal 10 is depressed, so cable 128 may be positioned in a location that avoids crimping or otherwise damaging cable 128 with each pedal depression. Cable 128 also may include or be coupled to a strain relief to limit or reduce deformation or damage to cable 128 over time.

In yet another embodiment, sensor 80 may be used to directly detect movement of some component of drive assembly 300 other than beater ring 70 or to indirectly detect movement of drive assembly 300/beater 100 via foot board 20, which is operatively coupled to drive assembly. In pedals having direct drives such as the one described above and shown in FIGS. 1-4, while allowing for variations due to tension adjustments and drive ring and beater ring adjustments, movement of foot board 20 may be linked directly to movement of beater 100. Because of the adjustability features, motion and velocity characteristics of foot board 20 in moving from a ready position to a strike position may not be directly proportional to those of beater 100, e.g., foot board may move at a relatively constant speed when being depressed whereas beater may accelerate rapidly. Regardless, foot board 20 may have identifiable, measurable characteristics from which strikes may be derived. For example, velocity of foot board 20 may decrease at a strike position, reach zero, and then increase in an opposite direction during recoil.

As compared to the direct drive system shown in FIGS. 1-4, other pedal systems may include chain or belt drives that may link foot board movement substantially directly to beater movement during down stroke of the foot board. (Foot board and beater may be slightly unlinked during a back or return stroke due to slack in the chain or belt, but sensor 80 already may have detected a hit by this point, so velocity or position variations in this stage may not negatively affect hit detection.) In these systems, strike detection using sensing of the pedal may be more like sensing of the beater or beater stem holder than in the direct drive pedal systems, because movement of the foot board may more directly correlate to movement of the beater.

In either case, beater movement may be inferable from foot board movement. Specifically, position information may be less important than velocity information, and heuristics may be used to determine strikes from velocity readings of foot board. sensing surface 112 may be located on, or operatively coupled to, foot board 20, and 80 may be positioned in a location that can view sensing surface 112. For example, foot board 20 may include a surface or an extension proximate the toe portion that is viewable by sensor 80. Alternatively, sensor 80 may view an encoder be mounted to foot board, e.g., a rotary encoder proximate heel pin 25 or axis of rotation of foot board 20. Further, as discussed in the embodiment above, sensor 80 may be positioned on or operatively coupled to foot board and may view a stationary sensing surface elsewhere on pedal 10. As still another alternative, instead of measuring velocity of foot board 20, a distance sensor such as an ultrasonic transducer or laser distance sensor may be used to monitor changes in position of foot board 20.

In still another embodiment, pedal 10 may omit use of beater 100 while still outputting signals correlating to the timing and strength of drum hits. For example, beater 100 and beater stem 110 may be removed from pedal 10 or pedal 10 may be an electronic pedal that includes a hard stop correlating to the strike position of foot board 20. Although a pedal in this configuration does not physically strike a drum head, similar velocity conditions may occur in this embodiment. For example, the drive assembly 300 may increase in speed as foot board 20 is depressed until the hard stop or the position representing a strike is reached. At that point, a rapid decrease in speed may occur, which may be followed by a change in direction and an increase in velocity in the opposite direction as the drive assembly 300 begins to move in the other direction. As such, a similar heuristic to the one described above may be used in this beater-less embodiment.

Similarly, instead of detecting strikes to the surface of a drum, pedal 10 may be used to detect impacts against a practice pad or another surface. As such, the user may not be required to have a drum or to set up a drum in front of pedal 10 in order to sense strikes and output signals corresponding to strikes. Although the specification may discuss detecting impacts with drum surfaces, the phrase "drum surface" or a similar phrase is intended to encompass additional surfaces contacted by the beater 100.

Sensing system may include a secondary mode that may detect and/or register a hit on both a forestroke and backstroke of beater 100, i.e., once when beater 100 hits the drum head and again when it reaches the initial, ready position. User may toggle secondary mode on and off, e.g., via a toggle switch. When turned on, secondary mode may allow the user effectively to play or record two hits with every pedal strike, allowing for a faster drumming effect.

In still another embodiment, the sensing system may be applied to a double-pedal configuration. Each pedal may include individual components such as those described for the single pedal configuration described above. In this embodiment, a cable may be connected to each input/output connector, and, preferably, both cables may go to a single stomp box. In both the single and double pedal embodiments, a power supply may be connected to, or part of, the stomp box. Power supply, which may be the equivalent of one or several AA batteries may provide power to components housed in sensor mount 90.

As described above, drum pedal 20 may include sensing assembly, e.g., sensor 80, sensor mount 90, sensing surface 112, etc. Alternatively, sensing assembly may be part of a kit for attaching to/detaching from an existing pedal. In either embodiment, pedal 20 may function as a standard drum pedal does, so that a user may be able to play a drum with it.

In yet another embodiment, microprocessor 122 may be supplemented with or replaced by other logic processors such as discrete logic components and/or analog components. For example, the logic employed to carry out a heuristic or algorithm may be implemented using a field gate programmable array (FGPA). Additionally, communication still may occur between sensor 80 and microprocessor 122, e.g., to tell sensor 80 when to begin detecting movement, but sensed movement or velocity values may be transmitted to a discrete logic chip for processing.

Alternatively, the signals received from a sensor such as a quadrature encoder may be transmitted into a series of counters, timers, and logic gates to obtain the same or substantially similar results as a heuristic carried out in microprocessor 122. The number and arrangement of these counters, timers, and logic gates may depend on the particular heuristic used.

In still another logic processor variation, an analog system may be employed where the frequency output coming from sensor 80, e.g., a quadrature encoder, may be converted to a voltage level corresponding to beater, foot board, or other drive assembly element speed. This voltage then may be transmitted through one or more op-amps or other circuit components in order to implement the logic. Again, the number and arrangement of circuit components may depend on the particular heuristic used.

While the foregoing written description of the invention enables one of ordinary skill to make and use what is considered presently to be the best mode thereof, those of ordinary skill will understand and appreciate the existence of variations, combinations, and equivalents of the specific exemplary embodiments and methods herein. The invention should therefore not be limited by the above described embodiments and methods, but by all embodiments and methods within the scope and spirit of the invention as claimed.

We claim:

1. A drum pedal comprising:

a base;

a pedestal extending generally upwardly from said base;

a foot board;

a drive system operatively connected to said foot board; and a sensor configured to sense motion of a sensing surface, the sensor operatively coupled to said pedal for directly or indirectly sensing motion of said drive system;

the sensing surface configured to remain generally perpendicular to said sensor as said foot board is depressed.

2. A drum pedal according to claim 1, said drive system comprising:

a beater operatively coupled to a beater holder, said beater holder including said sensing surface.

3. A drum pedal according to claim 2, wherein said sensing surface rotates as said beater rotates.

4. A drum pedal according to claim 2, wherein said sensing surface remains a substantially constant distance away from said sensor as said beater rotates.

5. A drum pedal according to claim 1, wherein said sensor includes an optical laser.

6. A drum pedal according to claim 1, further including a sensor mount fixedly coupled to said pedestal.

7. A drum pedal according to claim 6, said sensor mount including a cavity configured to receive said sensor.

8. A drum pedal according to claim 1, wherein said motion is velocity of a component of said drive system, and further wherein said sensor outputs signals corresponding to impacts based on changes in velocity.

9. A drum pedal sensing system comprising:

a sensor configured to remain a substantially constant distance away from a sensing surface during use, said sensor further configured to detect relative movement of the sensing surface and to detect direct or indirect motion of a drum beater;

a logic processor operatively coupled to said sensor and configured to receive signals from said sensor;

wherein said sensor outputs signals to said logic processor, said signals corresponding to velocity values of said drum beater;

and further wherein said logic processor evaluates said signals to determine when said drum beater reaches a strike position.

10. A drum pedal sensing system according to claim 9, wherein said logic processor is a microprocessor.

11. A drum pedal sensing system according to claim 9, further comprising:

a digital-to-analog converter operatively coupled to said logic processor.

12. A drum pedal sensing system according to claim 9, further comprising:

an input-output connector operatively coupled to said logic processor.

13. A drum pedal sensing system according to claim 12, further comprising a power supply, a stomp box, and a drum brain operatively coupled to said sensor and said logic processor via said input-output connector.

14. A drum pedal sensing system according to claim 9, wherein said logic processor outputs a signal each time it determines that said drum beater reaches said strike position, and further wherein said output signal is a square wave having an amplitude proportional to a strength of said strike.

15. A drum pedal sensing system, comprising:

a base;

a foot board;

a pedestal extending generally upwardly from said base;

a beater, beater stem, and beater holder operatively connected to a drive shaft and to said foot board;

a sensor holder; and a sensor fixedly coupled to said sensor holder;

wherein said beater holder includes a sensing surface;

wherein at least one of said sensor and said sensing surface is configured to rotate as said foot board is depressed;

wherein said sensor is configured to sense motion of said sensing surface;

and further wherein said sensing surface remains a substantially constant distance from said sensor as said sensing surface rotates.

16. A drum pedal sensing system according to claim 15, further comprising a drive shaft extending from said pedestal, wherein said beater holder and said sensor holder are coupled around said drive shaft.

17. A drum pedal sensing system according to claim 15, further comprising:

a microprocessor operatively coupled to said sensor;

wherein said sensor sends signals to said microprocessor corresponding to motion of said sensing surface;

and further wherein said microprocessor evaluates said signals to determine whether said beater has contacted a drum face.

18. A drum pedal sensing system according to claim 17, wherein said microprocessor is operatively coupled to a digital-to-analog converter, said microprocessor or said converter outputs a signal when said microprocessor determines that said beater has contacted said drum face.

19. A drum pedal sensing system according to claim 18, wherein an amplitude of said output signal is proportional to a strength of said contact of said beater with said drum face.

20. A drum pedal sensing system according to claim 15, said sensor holder having a cavity configured to house said sensor and a microprocessor, said sensor holder further having an opening for making a connection with an input/output connector.

* * * * *